US007017912B2

(12) United States Patent
Chiang

(10) Patent No.: US 7,017,912 B2
(45) Date of Patent: Mar. 28, 2006

(54) AQUATIC AMUSING TOY

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/910,279

(22) Filed: Aug. 4, 2004

(65) Prior Publication Data

US 2006/0027974 A1 Feb. 9, 2006

(51) Int. Cl.
*A63B 67/00* (2006.01)
*A63F 9/00* (2006.01)

(52) U.S. Cl. ..... 273/447; 446/329; 446/153; 446/156; 446/327

(58) Field of Classification Search ..... 273/440, 273/441, 445–447, 457, 459, 461, 329, 330, 273/348, 348.5, 350, 412, 408; 446/329, 446/330, 337–339, 153, 156, 304, 327; D21/597–599; 473/514, 503, 505; 434/254; 441/136, 56; 472/128; 294/99.1, 99.2
See application file for complete search history.

(56) References Cited

U.S. PATENT DOCUMENTS

| | | | | |
|---|---|---|---|---|
| 2,523,942 | A * | 9/1950 | Ciambriello | 294/19.2 |
| D204,183 | S * | 3/1966 | Corlin | D8/303 |
| 4,744,565 | A * | 5/1988 | Newberger | 273/342 |
| 5,810,364 | A * | 9/1998 | Canion | 273/459 |
| 6,220,599 | B1 * | 4/2001 | Eisch | 273/457 |
| 2002/0155901 | A1 * | 10/2002 | Ogg | 473/358 |

* cited by examiner

*Primary Examiner*—Raleigh W. Chiu
(74) *Attorney, Agent, or Firm*—Troxell Law Office PLLC

(57) ABSTRACT

An aquatic amusing toy is adapted for an aquatic game combining dive and amusement and includes a holding element and at least a sinking object. The holding element has a holding portion and a hollow portion defining an opening therein. In an aquatic game, the sinking object is pre-stored in water. The swimmer dives into water with the holding element. The sinking object is clamped in the opening and is taken out of water. The aquatic amusing toy has a shape like an aquatic animal biting a quarry, making the aquatic game more amusing.

3 Claims, 4 Drawing Sheets

AQUATIC AMUSING TOY

BACKGROUND OF THE INVENTION

1. Field of the Invention

The present invention relates to an aquatic amusing toy, and particularly to an aquatic amusing toy which is used for aquatic sport and amusement and which has a sinking object pre-stored in water and a holding element with an opening for accommodating the sinking object.

2. Related Art

A variety of children and youth likes aquatic games. Exciting and competitive aquatic games are more popular among youth. Some of them throw copper coins into water and compete for getting the copper coins first. Some of them compete for sinking in water for more time. People feel much amused from these aquatic games.

Sometimes, aquatic games combine dive with guessing game. For example, people are divided into different groups. Members of each group listen to riddles, and then dive into water to take answers which are pre-stored in water. The group who take the answers first is the winner. These aquatic games are amusing and in favor of health.

SUMMARY OF THE INVENTION

Accordingly, an object of the present invention is to provide an aquatic amusing toy which is used for an aquatic game combining dive and amusement and which is living and funny.

The aquatic amusing toy of the present invention comprises a sinking object and a holding element. The holding element has a holding portion and a hollow portion defining an opening therein. The sinking object has a width slightly larger than the width of the opening. In use, the sinking object is pre-stored in water. A swimmer dives into water with the holding element, and takes the sinking object out of water.

DESCRIPTION OF THE PREFERRED EMBODIMENTS

Figure 1:
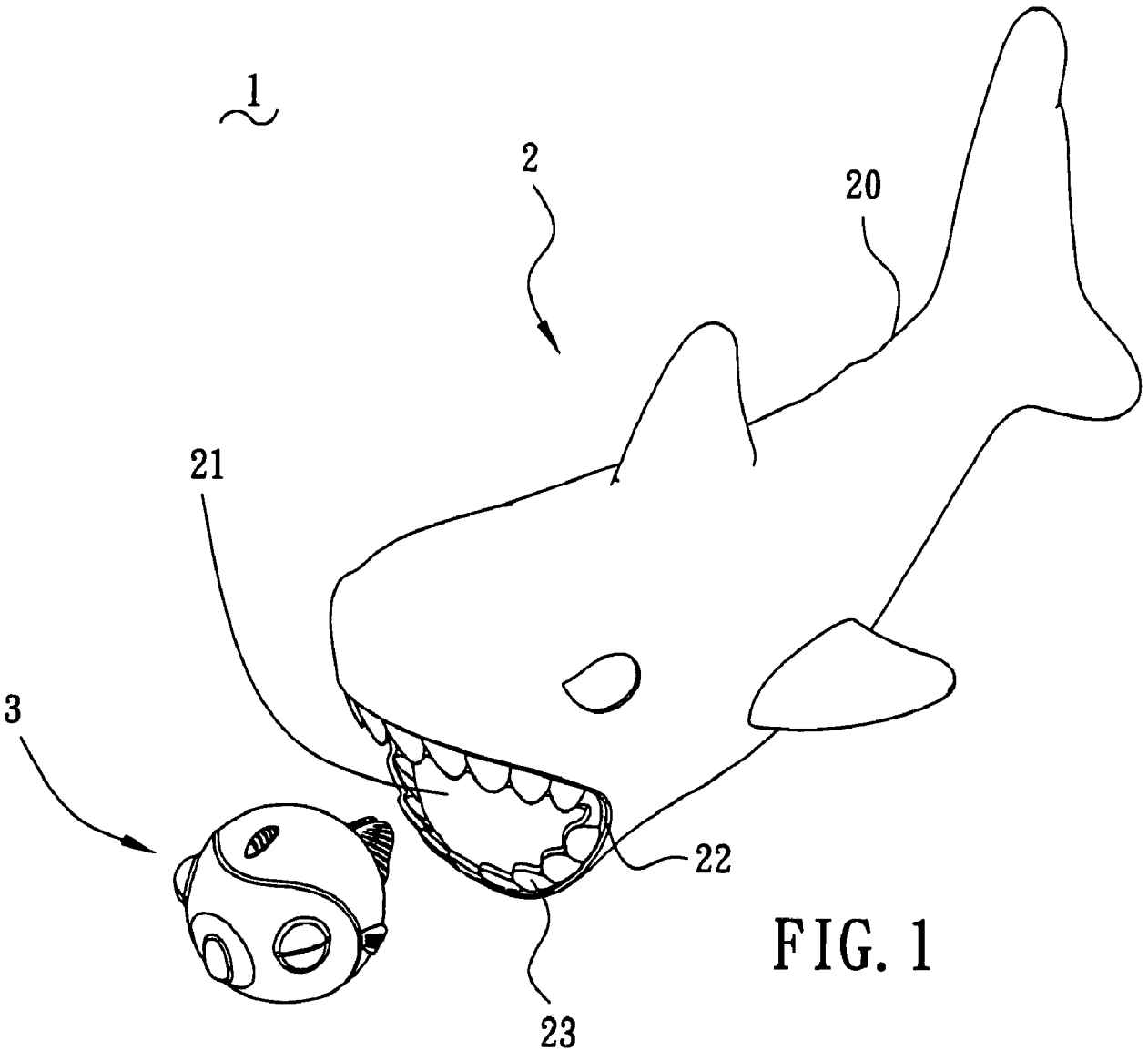
FIG. 1 is an exploded view of an aquatic amusing toy according to the present invention.
Figure 3:
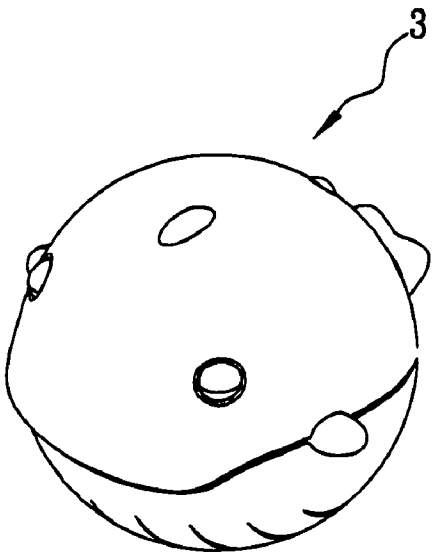
FIGS. 3–6 are perspective views of sinking objects of different shapes.
Figure 2:
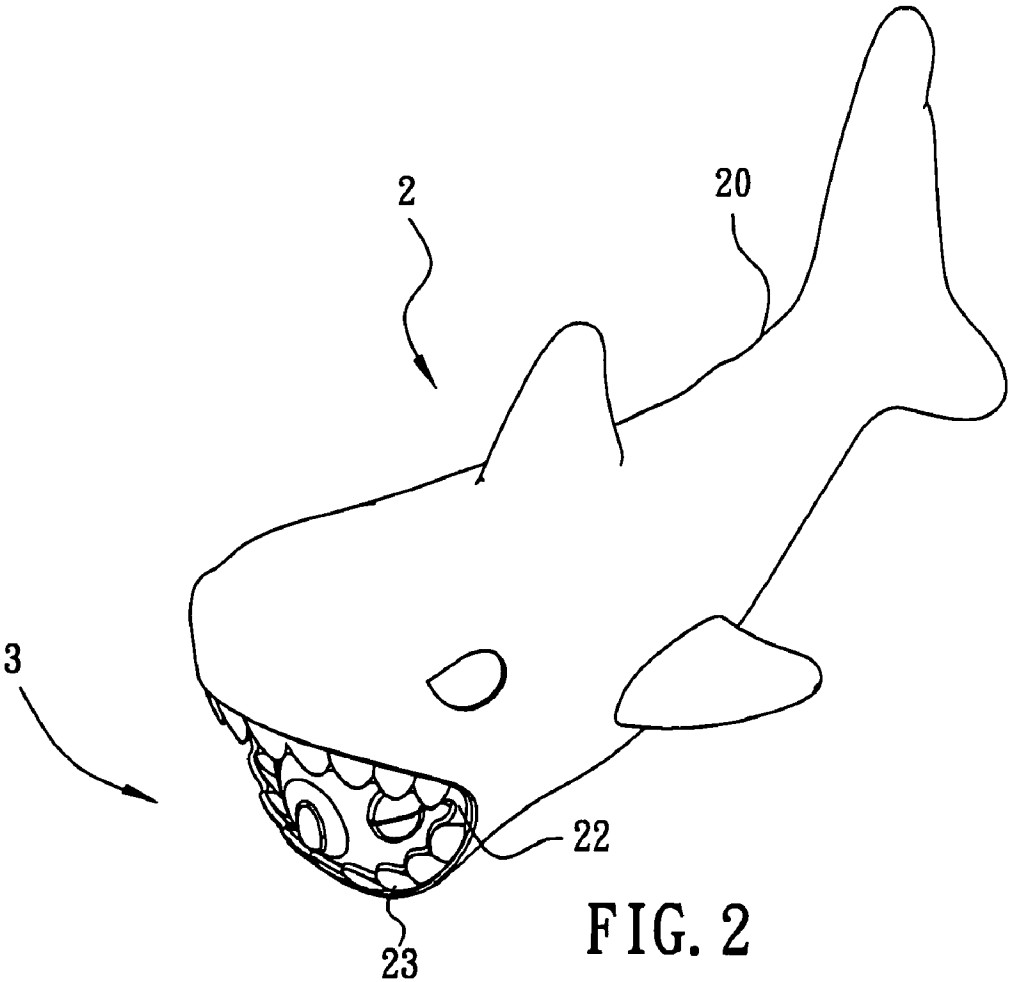
FIG. 2 is an assembled view of the aquatic amusing toy of FIG. 1.
Figure 5:
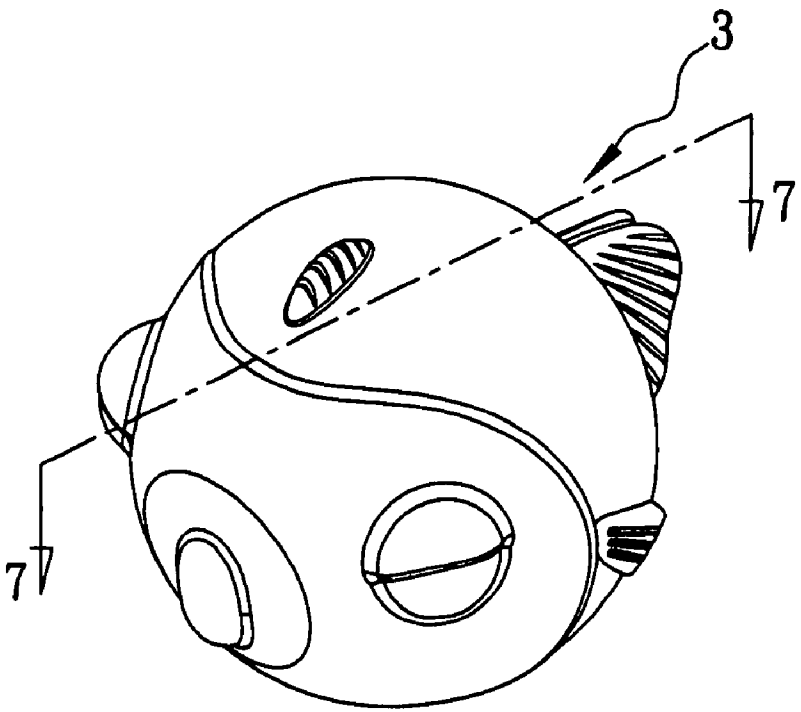
Figure 4:
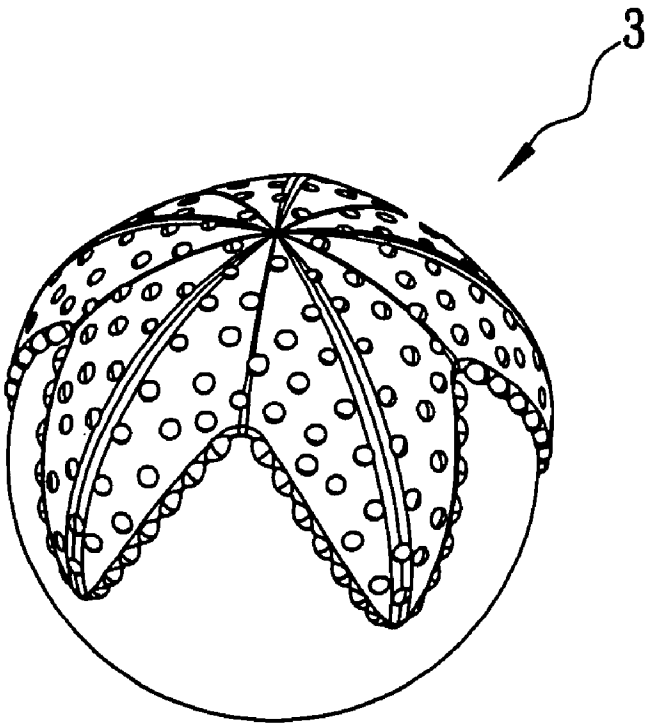

With reference to FIG. 1, an aquatic amusing toy 1 in accordance with the present invention comprises a holding element 2 and a plurality of sinking objects 3. The holding element 2 is integrally formed of plastic with plasticity and may be shaped of different animals. In one embodiment, the holding element 2 is shaped of a shark. The tail of the shark acts as a holding portion 20, the stomach of the shark acts as a hollow portion 21, and the opened mouth of the shark acts as the opening 22. A plurality of tooth-like portions 23 is formed in the opening 22. When the shark takes the sinking object 3, the opening 22 is appreciably opened due to plasticity of the shark. Thus the opening 22 easily accommodates the sinking object 3 therein (referring to FIG. 2). Moreover, the sinking object 3 is firmly clamped in the opening 22 due to the plasticity. Similarly, owing to the plasticity, the tooth-like portions 23 are opened slightly to get the sinking object 3 out of the opening 22.

Figure 7:
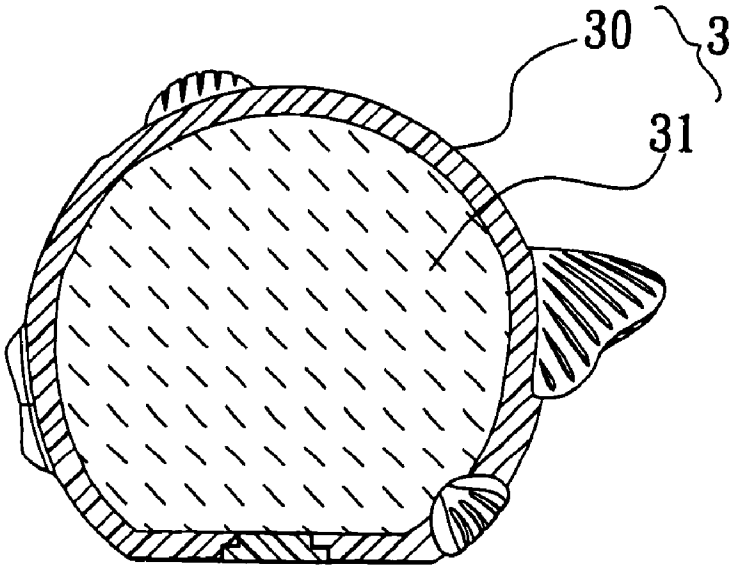
FIG. 7 is a cross-sectional view taking along the line 7—7 of FIG. 5.
Figure 6:
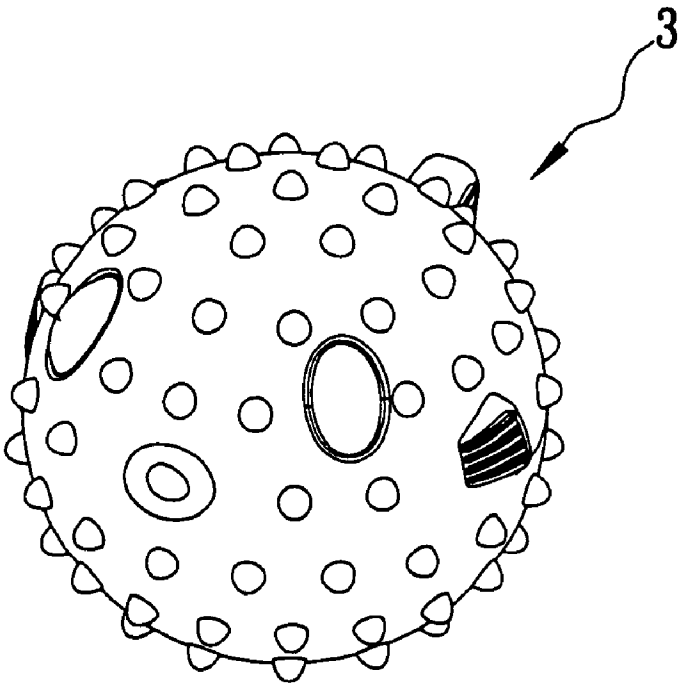

The sinking object 3 is integrally formed of plastic with plasticity and has ball-like shape. The width of the sinking object 3 is slightly larger than width of the opening 22. Combining with FIGS. 3–6, the sinking object 3 may be shaped of different animals, such as a balloonfish, a goldfish, an echinus or a small cetacean. Referring to FIG. 7, the sinking object 3 includes a shell 30 integrally formed of plastic with plasticity and stuffing 31 filled in the shell 30. The stuffing 31 may be oil for adding weight of the sinking object 3 thereby facilitating the sinking object 3 to sink into water.

At the beginning of an aquatic game, some sinking objects 3 are put into water in advance. The swimmers compete for taking two sinking objects 3 out of water and returning to the jumping-off point first. In the aquatic game, each swimmer holds a holding element 2 and dives into water from a predetermined jumping-off point. The swimmers clamp the sinking objects 3 between the tooth-like portions 23 in the openings 22. The aquatic amusing toy 1 is similar to an aquatic animal biting quarry, making the aquatic game more amusing.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An aquatic amusing toy adapted for aquatic games combing dive and amusement, comprising:

a holding element including a holding portion and a hollow portion connecting with each other, the hollow portion defining an opening; and at least a sinking object having width slightly larger than width of the opening and being sinkable in the water;

wherein a swimmer dives into the water with the holding element and clamps the sinking object with the opening to take the sinking object out of water, wherein the holding element is integrally formed of plastic with plasticity and is shaped of an aquatic animal.

2. The aquatic amusing toy as claimed in claim 1, wherein the holding element is shaped of a shark, and wherein the holding portion is the tail of the shark, the hollow portion is the stomach of the shark, and the opening is the opened mouth of the shark.

3. An aquatic amusing toy adapted for aquatic games combing dive and amusement, comprising:

a holding element including a holding portion and a hollow portion connecting with each other, the hollow portion defining an opening; and at least a sinking object having width slightly larger than width of the opening and being sinkable in the water;

wherein a swimmer dives into the water with the holding element and clamps the sinking object with the opening to take the sinking object out of water, wherein the sinking object is formed of plastic with plasticity and has ball-like shape, wherein the sinking object is shaped of different animals, such as a balloonfish, a goldfish, an echinus or a small cetacean.

* * * * *